US009138614B2

(12) United States Patent
Lu et al.

(10) Patent No.: US 9,138,614 B2
(45) Date of Patent: Sep. 22, 2015

(54) EXERCISE ASSEMBLIES HAVING LINEAR MOTION SYNCHRONIZING MECHANISM

(71) Applicant: Brunswick Corporation, Lake Forest, IL (US)

(72) Inventors: Zhi Lu, Glenview, IL (US); William James Kreuger, Hoffman Estates, IL (US); Byron T. DeKnock, Des Plaines, IL (US); Gary Scott Clayton, Wheaton, IL (US)

(73) Assignee: Brunswick Corporation, Lake Forest, IL (US)

( * ) Notice: Subject to any disclaimer, the term of this patent is extended or adjusted under 35 U.S.C. 154(b) by 84 days.

(21) Appl. No.: 14/047,448

(22) Filed: Oct. 7, 2013

(65) Prior Publication Data

US 2014/0248999 A1 Sep. 4, 2014

Related U.S. Application Data

(63) Continuation-in-part of application No. 13/783,610, filed on Mar. 4, 2013, now Pat. No. 9,050,498.

(51) Int. Cl.

| | |
|---|---|
| ***A63B 21/00*** | (2006.01) |
| ***A63B 22/00*** | (2006.01) |
| ***A63B 22/06*** | (2006.01) |

(52) U.S. Cl.

CPC ..... *A63B 21/154* (2013.01); *A63B 22/001* (2013.01); *A63B 22/0664* (2013.01); *A63B 2022/0682* (2013.01)

(58) Field of Classification Search

USPC ..... 482/51–52, 57–65

See application file for complete search history.

(56) References Cited

U.S. PATENT DOCUMENTS

| | | | |
|---|---|---|---|
| 321,388 | A | 6/1885 | Ruebsam |
| 652,612 | A | 6/1900 | Harrison |
| 663,486 | A | 12/1900 | Boren |
| 881,521 | A | 3/1908 | Wilson |
| 931,394 | A | 8/1909 | Day |
| 1,020,777 | A | 3/1912 | Peterson |

(Continued)

FOREIGN PATENT DOCUMENTS

| | | |
|---|---|---|
| CA | 2064657 | 10/1993 |
| DE | 83466 | 4/1895 |

(Continued)

OTHER PUBLICATIONS

International Search Report and Written Opinion, PCT/US2014/013820, date of mailing May 12, 2014.

(Continued)

*Primary Examiner* — Stephen Crow

(74) *Attorney, Agent, or Firm* — Andrus Intellectual Property Law, LLP

(57) ABSTRACT

An exercise assembly comprises elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

30 Claims, 13 Drawing Sheets

(56) References Cited

U.S. PATENT DOCUMENTS 1,715,870 A 6/1929 Spain
1,850,530 A 3/1932 Brown
1,902,694 A 3/1933 Edwards
1,928,089 A 9/1933 Blickman
1,973,945 A 9/1934 Chavin et al.
2,453,771 A 11/1948 White et al.
2,648,330 A 8/1953 Clark
2,855,200 A 10/1958 Blickman
3,127,171 A 3/1964 Noland et al.
D207,541 S 5/1967 Hesen
3,378,259 A 4/1968 Kupchinski
D211,801 S 7/1968 Quinton
3,444,830 A 5/1969 Doetsch
3,563,541 A 2/1971 Sanquist
3,586,322 A 6/1971 Kverneland
3,589,715 A 6/1971 Mark
3,614,097 A 10/1971 Blickman
3,642,279 A 2/1972 Cutter
3,659,845 A 5/1972 Quinton
3,731,917 A 5/1973 Townsend
3,741,538 A 6/1973 Lewis et al.
3,745,990 A 7/1973 Neis
3,756,595 A 9/1973 Hague
3,758,111 A 9/1973 Agamian
3,824,993 A 7/1974 Grant
3,874,657 A 4/1975 Niebojewski
3,918,710 A 11/1975 Niebojewski
3,966,201 A 6/1976 Mester
4,026,545 A 5/1977 Schonenberger
4,066,257 A 1/1978 Moller
4,185,622 A 1/1980 Swenson
4,235,437 A 11/1980 Ruis et al.
4,248,476 A 2/1981 Phelps
4,300,761 A 11/1981 Howard
4,383,714 A 5/1983 Ishida
4,422,635 A 12/1983 Herod et al.
4,436,097 A 3/1984 Cunningham
4,519,604 A 5/1985 Arzounian
4,576,377 A 3/1986 Wolff
4,625,962 A 12/1986 Street
4,664,646 A 5/1987 Rorabaugh
4,666,173 A 5/1987 Graham
4,679,787 A 7/1987 Guilbault
4,757,987 A 7/1988 Allemand
4,786,050 A 11/1988 Geschwender
4,805,901 A 2/1989 Kulick
4,826,153 A 5/1989 Schalip
4,842,269 A 6/1989 Huang
4,846,156 A 7/1989 Kopnicky
4,872,669 A 10/1989 Henry
4,881,732 A 11/1989 Kepiro
4,905,330 A 3/1990 Jacobs
4,913,396 A 4/1990 Dalebout et al.
4,913,423 A 4/1990 Farran et al.
4,921,247 A 5/1990 Sterling
4,938,474 A 7/1990 Sweeney et al.
4,974,831 A 12/1990 Dunham
4,998,725 A 3/1991 Watterson et al.
5,002,271 A 3/1991 Gonzales
5,029,801 A 7/1991 Dalebout et al.
5,058,881 A 10/1991 Measom
5,102,380 A 4/1992 Jacobson et al.
5,108,092 A 4/1992 Hurst
5,109,778 A 5/1992 Berkowitz et al.
5,110,117 A 5/1992 Fisher et al.
5,121,654 A 6/1992 Fasce
5,184,988 A 2/1993 Dunham
5,186,697 A 2/1993 Rennex
5,192,255 A 3/1993 Dalebout et al.
5,199,931 A 4/1993 Easley et al.
5,207,622 A 5/1993 Wilkinson et al.
5,207,628 A 5/1993 Graham
5,242,343 A 9/1993 Miller
5,279,529 A 1/1994 Eschenbach
5,282,776 A 2/1994 Dalebout
5,295,928 A 3/1994 Rennex
5,299,992 A 4/1994 Wilkinson
5,352,167 A 10/1994 Ulicny
5,352,169 A 10/1994 Eschenbach
5,372,559 A 12/1994 Dalebout et al.
5,383,829 A 1/1995 Miller
5,423,729 A 6/1995 Eschenbach
5,429,563 A 7/1995 Engel et al.
5,441,467 A 8/1995 Stevens
5,452,910 A 9/1995 Harris
5,453,066 A 9/1995 Richter, Jr.
5,518,473 A 5/1996 Miller
5,529,554 A 6/1996 Eschenbach
5,529,555 A 6/1996 Rodgers, Jr.
5,536,225 A * 7/1996 Neuberg et al. ..... 482/71
5,540,637 A 7/1996 Rodgers, Jr.
5,549,526 A 8/1996 Rodgers, Jr.
5,562,574 A 10/1996 Miller
5,573,480 A 11/1996 Rodgers, Jr.
5,577,985 A 11/1996 Miller
5,611,756 A 3/1997 Miller
5,616,111 A * 4/1997 Randolph ..... 482/133
5,626,538 A 5/1997 Dalebout et al.
5,637,058 A 6/1997 Rodgers, Jr.
5,692,994 A 12/1997 Eschenbach
5,735,774 A 4/1998 Maresh
5,879,271 A 3/1999 Stearns et al.
5,893,820 A * 4/1999 Maresh et al. ..... 482/51
5,895,339 A 4/1999 Maresh
5,935,046 A 8/1999 Maresh
5,947,872 A 9/1999 Ryan et al.
6,042,515 A 3/2000 Wang
6,045,487 A 4/2000 Miller
6,084,325 A 7/2000 Hsu
6,110,076 A 8/2000 Hurt
6,135,925 A 10/2000 Liu
6,142,915 A 11/2000 Eschenbach
6,168,552 B1 1/2001 Eschenbach
6,183,397 B1 2/2001 Stearns et al.
6,183,398 B1 2/2001 Rufino et al.
6,206,804 B1 * 3/2001 Maresh ..... 482/52
6,206,806 B1 3/2001 Chu
6,248,044 B1 6/2001 Stearns et al.
6,390,953 B1 5/2002 Maresh et al.
6,482,132 B2 11/2002 Eschenbach
6,544,146 B1 4/2003 Stearns et al.
6,648,800 B2 11/2003 Stearns et al.
6,689,020 B2 2/2004 Stearns et al.
6,846,273 B1 1/2005 Stearns et al.
6,855,093 B2 2/2005 Anderson et al.
RE38,803 E 9/2005 Rodgers, Jr.
7,060,005 B2 6/2006 Carlsen et al.
7,112,161 B2 9/2006 Maresh
7,153,239 B1 12/2006 Stearns et al.
7,175,568 B2 2/2007 Eschenbach
7,344,480 B2 3/2008 Maresh et al.
7,479,093 B1 1/2009 Immordino et al.
7,485,072 B2 2/2009 Chuang
7,494,447 B2 2/2009 Eschenbach
7,520,839 B2 * 4/2009 Rodgers, Jr. ..... 482/52
7,530,926 B2 * 5/2009 Rodgers, Jr. ..... 482/52
7,625,317 B2 12/2009 Stevenson et al.
7,682,288 B1 3/2010 Stearns et al.
7,717,833 B1 5/2010 Nelson et al.
7,771,324 B2 8/2010 Anderson et al.
7,828,698 B2 11/2010 Rodgers, Jr.
7,841,968 B1 11/2010 Eschenbach
7,887,465 B2 2/2011 Uffelman
7,918,766 B2 4/2011 Lu et al.
7,931,566 B1 4/2011 Radke et al.
8,105,213 B2 1/2012 Stewart
8,272,997 B2 9/2012 Anderson et al.
2002/0094914 A1 7/2002 Maresh et al.
2005/0049117 A1 3/2005 Rodgers et al.
2005/0181911 A1 8/2005 Porth
2005/0202939 A1 9/2005 Lull et al.
2005/0250621 A1 11/2005 Corbalis et al.
2005/0277516 A1 12/2005 Girard et al.
2007/0179023 A1 8/2007 Dyer

(56) References Cited

U.S. PATENT DOCUMENTS

| | | | | |
|---|---|---|---|---|
| 2008/0242516 | A1 | 10/2008 | Lu et al. | |
| 2009/0156369 | A1 | 6/2009 | Rodgers, Jr. | |
| 2012/0058862 | A1 | 3/2012 | Anderson et al. | |
| 2012/0289380 | A1 | 11/2012 | Chen | |
| 2014/0249000 | A1* | 9/2014 | Lu et al. | 482/52 |

FOREIGN PATENT DOCUMENTS

| | | |
|---|---|---|
| DE | 2 225 342 | 5/1972 |
| DE | 24 08 052 | 2/1974 |
| DE | 4404831 | 12/1994 |
| GB | 1 169 148 | 10/1969 |
| GB | 1 326 263 | 8/1973 |
| GB | 1348716 | 3/1974 |
| GB | 1 505 702 | 3/1978 |
| GB | 2 120 560 | 12/1983 |
| JP | 56-56358 | 5/1981 |
| JP | 56-150562 | 11/1981 |

OTHER PUBLICATIONS

International Search Report and Written Opinion, PCT/US2014/013821, mailed May 21, 2014.

International Search Report and Written Opinion, PCT/US2014/013817, mailed May 21, 2014.

* cited by examiner

EXERCISE ASSEMBLIES HAVING LINEAR MOTION SYNCHRONIZING MECHANISM

CROSS-REFERENCE TO RELATED APPLICATION

The present application is a continuation-in-part of U.S. patent application Ser. No. 13/783,610, filed Mar. 4, 2013, which is incorporated herein by reference in entirety.

FIELD

The present disclosure relates to exercise assemblies.

BACKGROUND

U.S. Pat. No. 6,084,325, which is incorporated herein by reference in entirety discloses a resistance device with a combination of power-generating and eddy-current magnetic resistance having an outer fly wheel fastened on a central axle of a frame and fitted with a permanent magnet on the inner circular edge to form a rotor type, and the fly wheel is connected with a stator core fastened on the frame: more, one end of the central axle is stretching out of the frame and fitted with a belt wheel; the front end of the frame is fitted with a resistance device core adjacent to the outer edge of the fly wheel to supply a planned eddy current magnetic resistance to the fly wheel; in accordance with such design, the device generates power by means of the exercise force of users to drive the fly wheel to rotate, after passing through a DC power supply, it provides display & controlling gage with power source so that the power-generating and the eddy current magnetic resistance are integrated to reach the effect of reducing the volume and the producing cost.

U.S. Pat. No. 7,479,093, which is incorporated herein by reference in entirety discloses exercise apparatus having a pair of handles pivotally mounted on a frame and guiding respective user arm motions along swing paths obliquely approaching the sagittal plane of the user.

U.S. Pat. No. 7,625,317, which is incorporated herein by reference in entirety discloses exercise apparatus with a coupled mechanism providing coupled natural biomechanical three dimensional human motion.

U.S. Pat. No. 7,717,833, which is incorporated herein by reference in entirety discloses adjustable exercise machines, apparatuses, and systems. The disclosed machines, apparatuses, and systems typically include an adjustable, reversible mechanism that utilizes pivoting arms and a floating pulley. The disclosed machines, apparatuses, and systems typically are configured for performing pushing and pulling exercises and may provide for converging and diverging motion.

U.S. Pat. No. 7,918,766, which is incorporated herein by reference in entirety discloses an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the toot pedals will describe a generally elliptical path in response to user foot motion on the pedals.

U.S. Pat. No. 7,931,566, which is incorporated herein by reference in entirety discloses exercise apparatus, which may be an elliptical cross trainer, having a rotating inertial flywheel driven by user-engaged linkage exercising a user. A user-actuated resistance device engages and stops rotation of the flywheel upon actuation by the user.

U.S. Pat. No. 8,272,997, which is incorporated herein by reference in entirety, discloses a dynamic link mechanism in an elliptical step exercise apparatus that can be used to vary the stride length of the machine. A control system can also be used to van stride length as a function of various exercise and operating parameters such as speed and direction as well as varying stride length as a part of a preprogrammed exercise routine such as a hill or interval training program. In addition the control system can use measurements of stride length to optimize operation of the apparatus.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an exercise assembly comprises elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis. The slider and linkage together restrict pivoting motion of the first and second rocker arms to opposite directions and at equal angular velocity with respect to each other.

In certain examples, an exercise assembly comprises a frame, a pair of elongated foot pedal members, each foot pedal member having a front portion and a rear portion. A pair of foot pads is provided, each foot pad being disposed on the rear portion of one of the pair of foot pedal members. A pair of elongated coupler arms is provided, each coupler arm having a lower portion and having an upper portion that is pivotally connected to the frame. A pair of crank members is provided. Each crank member has a first portion that is pivotally connected to the front portion of one of the pair of foot pedal members and a second portion that is pivotally connected to the lower portion of one of the pair of coupler arms, such that each crank member is rotatable in a circular path. A pair of elongated rocker arms is provided. Each rocker arm has a lower portion that is pivotally connected to one of the pair of foot pedal members in between the foot pad and the crank member and an upper portion that is pivotally connected to the frame. The pair of foot pedal members are each movable along user-defined paths of differing dimensions. The pair of rocker arms oppositely pivot with respect to each other and the frame in a scissors-like motion about a first pivot axis. A slider is provided. The slider has a slider body that slides along a linear axis extending through and perpendicular to the first pivot axis. A linkage pivotally couples the first and second rocker arms to the slider body. Pivoting of the pair of rocker arms with respect to each other causes the slider body to slide in a first direction along the linear axis. Opposite pivoting of the pair of rocker arms with respect to each other causes the slider body to slide in an opposite, second direction along the linear axis.

In certain examples, an exercise assembly is provided. Elongated first and second rocker arms pivot with respect to each other in a scissors-like motion about a first pivot axis. A slider has a slider body that slides along a linear axis extending through and perpendicular to the first pivot axis. A linkage pivotally couples the first and second rocker arms to the slider body. The slider and the linkage together restrict pivoting motion of the first and second rocker arms to opposite directions and at equal angular velocity with respect to each other. The linkage can have a first linkage portion for the first rocker arm and a second linkage portion for the second rocker arm, the first and second linkage portions being pivotally connected to the slider at a second pivot axis. The second pivot axis extends parallel to the first pivot axis.

In certain examples, each of the first and second linkage portions comprises a linear extension arm having first and second ends and a radial crank arm having first and second ends. The first end of the extension arm is pivotally coupled to the slider at the second pivot axis. The second end of the extension arm is pivotally coupled to the first end of the crank arm. The second end of the crank arm is fixed to and rotates with one of the first and second rocker arms. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

BRIEF DESCRIPTION OF THE DRAWINGS

Examples of exercise assemblies are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different assemblies described herein may be used alone or in combination with other apparatuses. Various equivalents, alternatives, and modifications are possible within the scope of the appended claims.

Figure 1:
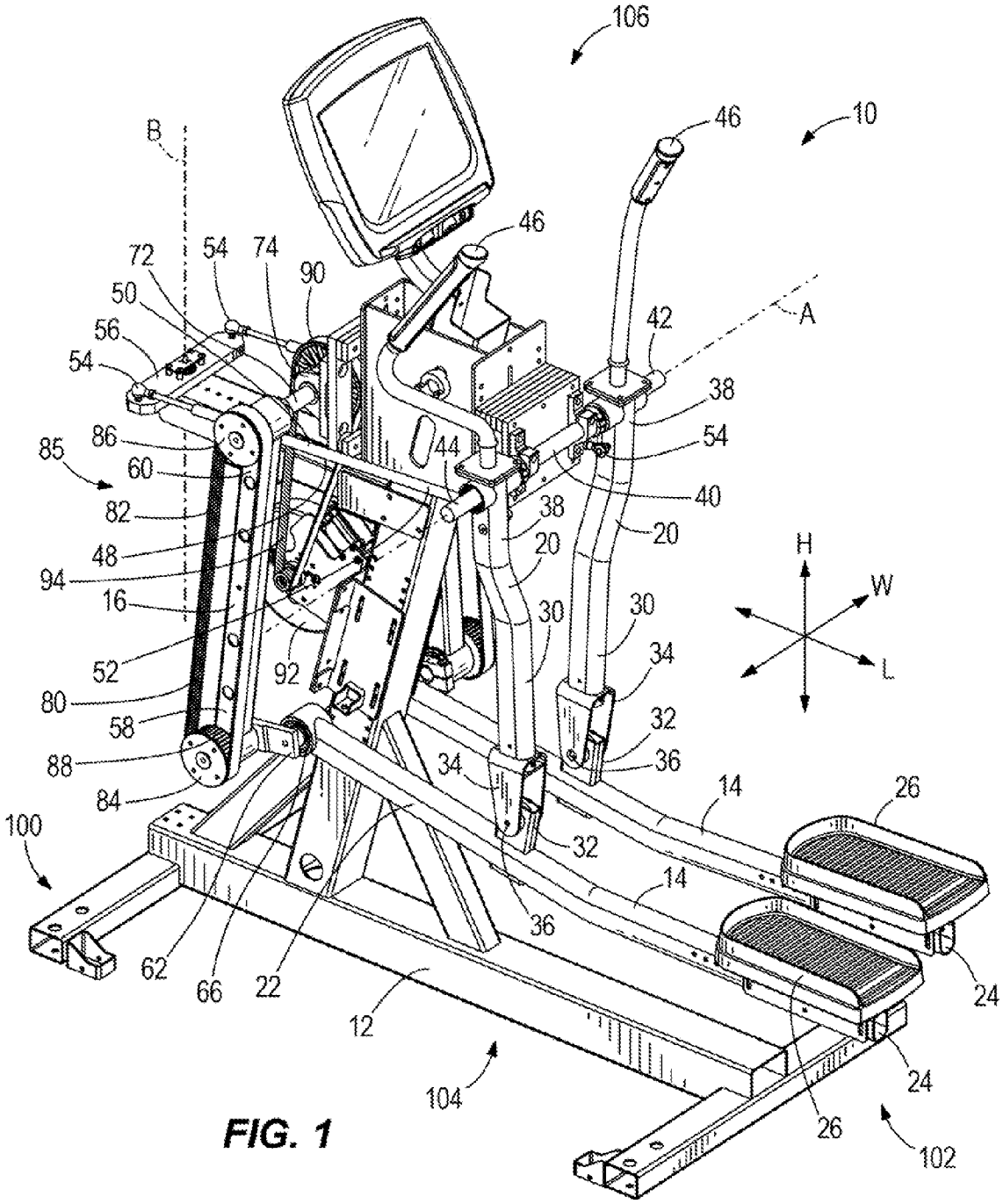
FIG. 1 is a perspective view of an exercise assembly.
Figure 2:
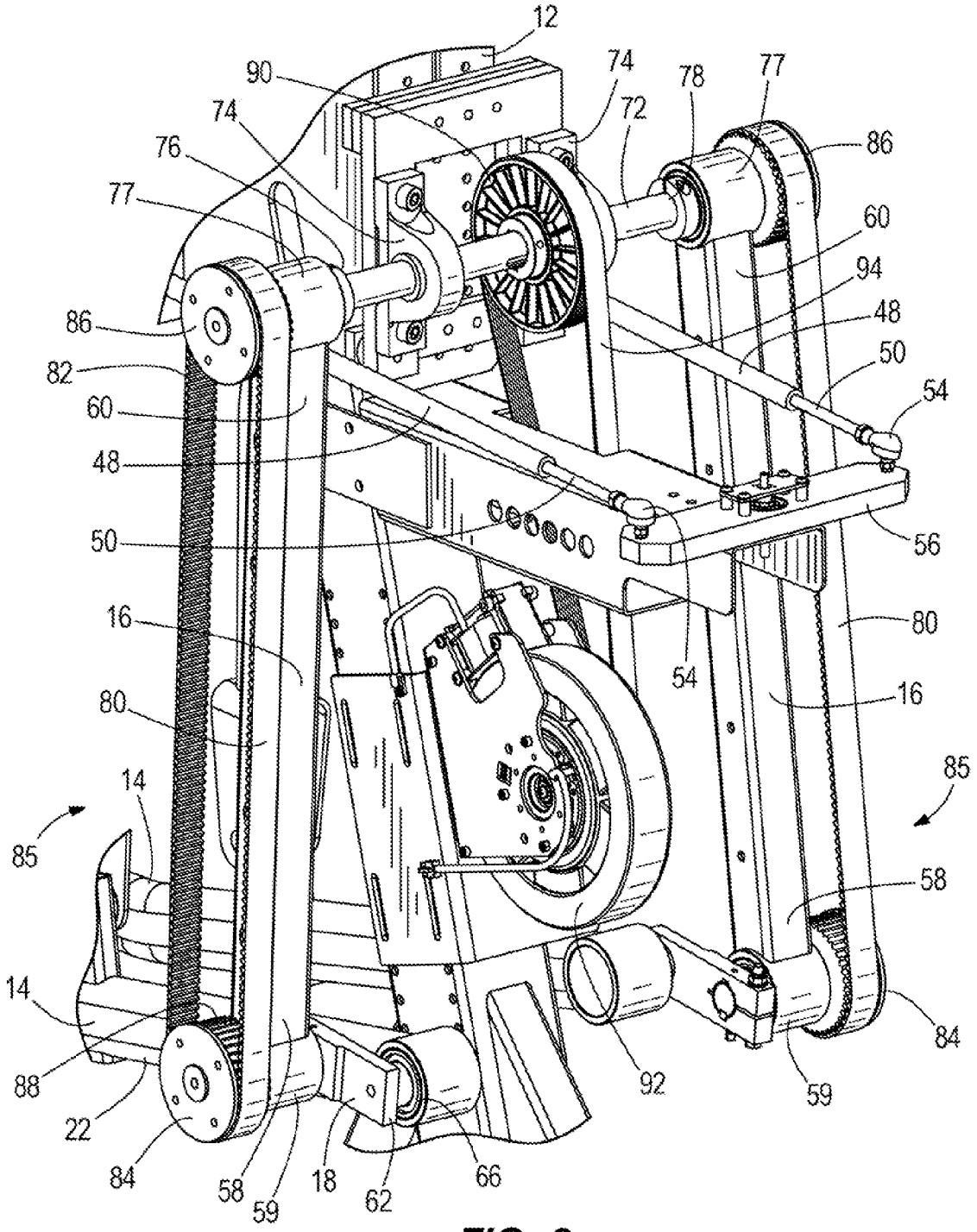
FIG. 2 is a closer view of a front portion of the exercise assembly.
Figure 3:
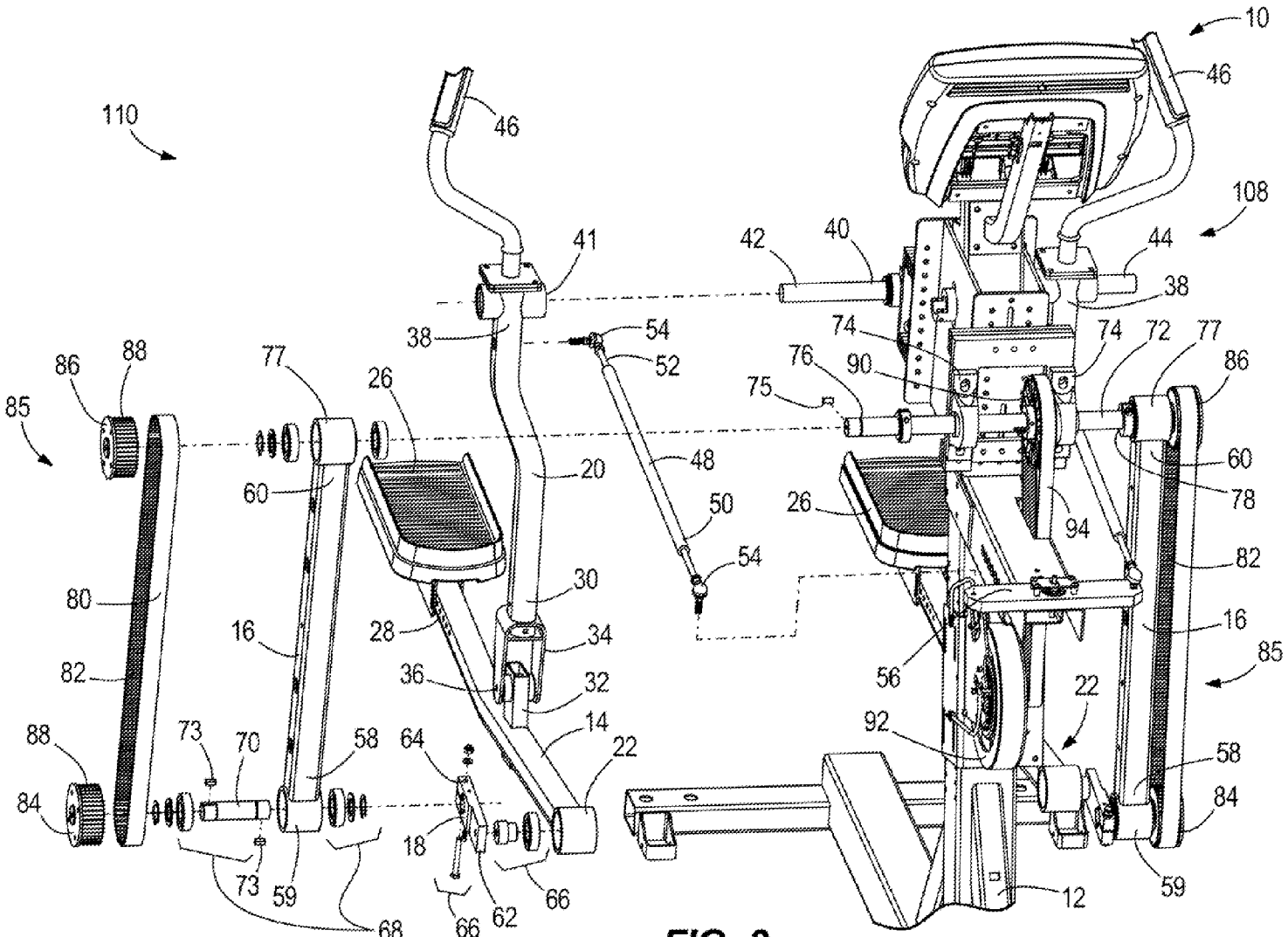
FIG. 3 is an exploded view of one side of the exercise assembly.

FIGS. 1-3 depict an exercise assembly 10 having a frame 12, a pair of elongated foot pedal members 14, a pair of elongated coupler arms 16, a pair of crank members 18 and a pair of elongated rocker arms 20. Each foot pedal member 14 has a front portion 22 and a rear portion 24. A pair of foot pads 26 is provided for supporting a user's feet. Each foot pad 26 is disposed on the rear portion 24 of one of the pair of foot pedal members 14. Each rocker arm 20 has a lower portion 30 that is pivotally connected to one of the pair of foot pedal members 14 at a location that is between the foot pad 26 and the crank member 18. Any type of pivotal connection can be employed. In this example, an extension member 32 extends vertically upwardly from the foot pedal member 14 and pivotally connects a lower portion 30 of a rocker arm 20 to the foot pedal member 14. A U-shaped bracket 34 and a connecting pin 36 facilitate the connection such that the rocker arms 20 are pivotal with respect to the foot pedal members 14. Each extension member 32 extends upwardly from one of the respective pair of foot pedal members 14 and the U-shaped bracket 34 extends downwardly from the lower portion 30 of the respective rocker arms 20.

Each rocker arm 20 has an upper portion 38 that is directly or indirectly pivotally connected to the frame 12. The manner of connection to the frame 12 can vary. In this example, a rear cross-shaft 40 is secured to the frame 12 and has opposite ends 42, 44 on which the upper portions 38 of the rocker arms 20 are pivotally supported. In this example, the ends 42, 44 extend through respective bearings 41 in the rocker arms 20 to enable the freely rotatable, pivotal connection therewith. Thus, the pair of rocker arms 20 pivot about a common axis A, which extends through the rear cross-shaft 40.

A pair of handles 46 are disposed on the pair of rocker arms 20 and extend upwardly above the cross-shaft 40 such that movement of the handle 46 in a pivoting, rotational motion with respect to the axis A of the rear cross-shaft 40 causes similar, following pivoting, rotational motion of the lower portion 30 of the rocker arm 20.

Elongated link members 48 each have a front portion 50 and a rear portion 52. The rear portion 52 is pivotally connected to one of the pair of rocker arms 20 In this example, the connection between the rear portion 52 of the link member 48 and the rocker arm 20 is provided by a pivotal joint 54. A cross-link member 56 is pivotally connected to the frame 12 at a pivot axis B that extends between the link members 48. The front portions 50 of the link members 48 are pivotally connected to opposite ends of the cross-link member 56. In this example, the connection is made by pivotal joints 54. In this manner, the noted pivoting movement of each rocker arm 20 with respect to the axis A is translated to the other rocker arm 20 via the link members 48 acting on the opposite ends of the cross-link member 56, which in turn pivots about the noted pivot axis B.

The pair of coupler arms 16 each has a lower portion 58 and an upper portion 60. Each crank member 18 has a first end or portion 62 that is pivotally connected to the front portion 22 of one of the pair of foot pedal members 14 and also has a second end or portion 64 that is pivotally connected to the lower portion 58 of one of the pair of coupler arms 16. Connection of the first portion 62 of each crank member 18 is facilitated by a bearing, and pin assembly 66 configured such that the crank member 18 freely rotates with respect to the foot pedal member 14. Connection of the second portion 64 of the crank member 18 to the lower portion 58 of the coupler arm 16 is facilitated by a bearing and through shaft assembly 68, wherein a through shaft 70 extends through a hub 59 in the lower portion 58 of the coupler arm 16 so that the coupler arm 16 can freely pivot with respect to the through shaft 70.

A front cross-shaft 72 is connected to the frame 12 by a pair of bearings 74. The front cross-shaft 72 has opposing ends 76, 78 on which the upper portions 60 of the coupler arms 16 freely pivotally rotate. In this example, the front cross-shaft 72 effectively pivotally connects the upper portions 60 of the pair of coupler arms 16 to the frame 12 through bearings in hub 77 in the upper portions 60.

A pair of timing belts 80 having internal grooves 82 is connected at one end to the second portion 64 of the crank members 18 such that movement of the crank members 18 causes rotation of the respective timing belt 80. In this example, a pair of lower timing pulleys 84 is rotatably, fixedly connected to the crank members 18 via the bearing and through shaft. assembly 68 such that rotation of the crank members 18 causes rotation of the lower timing pulleys 84. In this example, the fixed rotational connection is provided by locking keys 73. The timing belts 80 are fixedly, rotatably connected at their upper end to the opposing ends 76, 78 of the front cross-shaft 72 such that rotation of the timing belts 80 causes rotation of the front cross-shaft 72. Connection between the timing belts 80 and the front cross-shaft 72 is facilitated by a pair of upper timing pulleys 86. Upper timing pulleys 86 are connected to one end of the front cross-shaft 72 and transfer rotational movement of the respective timing belt 80 to the front cross-shaft 72. Each of the upper and lower timing pulleys 84, 86 have external ridges 88 that engage with the internal grooves 82 on the timing belts 80 to thereby transfer the noted rotation between the timing pulleys 84, 86 and timing belts 80. In this example, the fixed rotational connection between the timing pulleys 86 and front cross-shaft 72 is provided by locking keys 75.

A pulley 90 is rotationally fixed with and connected to a center portion of the front cross-shaft 72 such that rotation of the front cross-shaft 72 causes rotation of the pulley 90. A resistance device 92 is connected to the frame 12. The resistance device 92 can include one or more of any conventional resistance device, such as the resistance device having a combination of power generating and eddy current magnetic resistance disclosed in the incorporated U.S. Pat. No. 6,084,325. A pulley belt 94 connects the resistance device 92 to the pulley 90 such that rotation of the pulley 90 (which is caused by rotation of the front cross-shaft 72) is translated to the resistance device 92 by the pulley belt 94. In this example, the resistance device 92 generates power based upon rotation of the pulley 90.

It will thus be seen from drawing FIGS. 1-3 that the present disclosure provides an exercise assembly 10 that extends from a front end 100 to a back end 102 in a length direction L, from a lower end 104 to an upper end 106 in a height direction H that is perpendicular to the length direction L, and from a first side 108 to a second side 110 in a width direction W that is perpendicular to the height direction H and perpendicular to the length direction L. In these examples, the assembly 10 has the noted pair of elongated foot pedal members 14, each of which extend in the length direction L between the front portion 22 and rear portion 24. The pair of foot pads 26 is disposed on the rear portion 24 of one of the foot pedal members 14. The pair of elongated coupler arms 16 extends in the height direction H between a lower portion 58 and an upper portion 60. The pair of crank members 18 extend between the first portion 62 that is pivotally connected to the front portion 22 of one of the pair of foot pedal members 14 and the second portion 64 that is pivotally connected to the lower portion 58 of one of the coupler arms 16, such that each crank member 18 is rotatable in the circular path C (see FIG. 4) with respect to the coupler arm 16 and foot pedal member 14 when viewed from the first and second sides 108, 110. The pair of elongated rocker arms 20 each has the lower portion 30 that is pivotally connected to one of the pair of foot pedal members 14 in between the foot pad 26 and the crank member 18. As described further herein below, the pair of foot pedal members 14 are each movable along generally elliptical, vertical and horizontal paths of differing dimensions when viewed from the first and second sides 108, 110. The pair of elongated link members 48 extends in the length direction L between a front portion 50 and a rear portion 52 that is pivotally connected to one of the pair of rocker arms 20. The cross-link member 56 extends the width direction W between opposite ends. The front portions 50 of the link members 48 are pivotally connected to one of the opposite ends of the cross-link member 56. The cross-link member 56 pivots about the axis B disposed between the pair of link members 48 in the width direction W.

Figure 4:
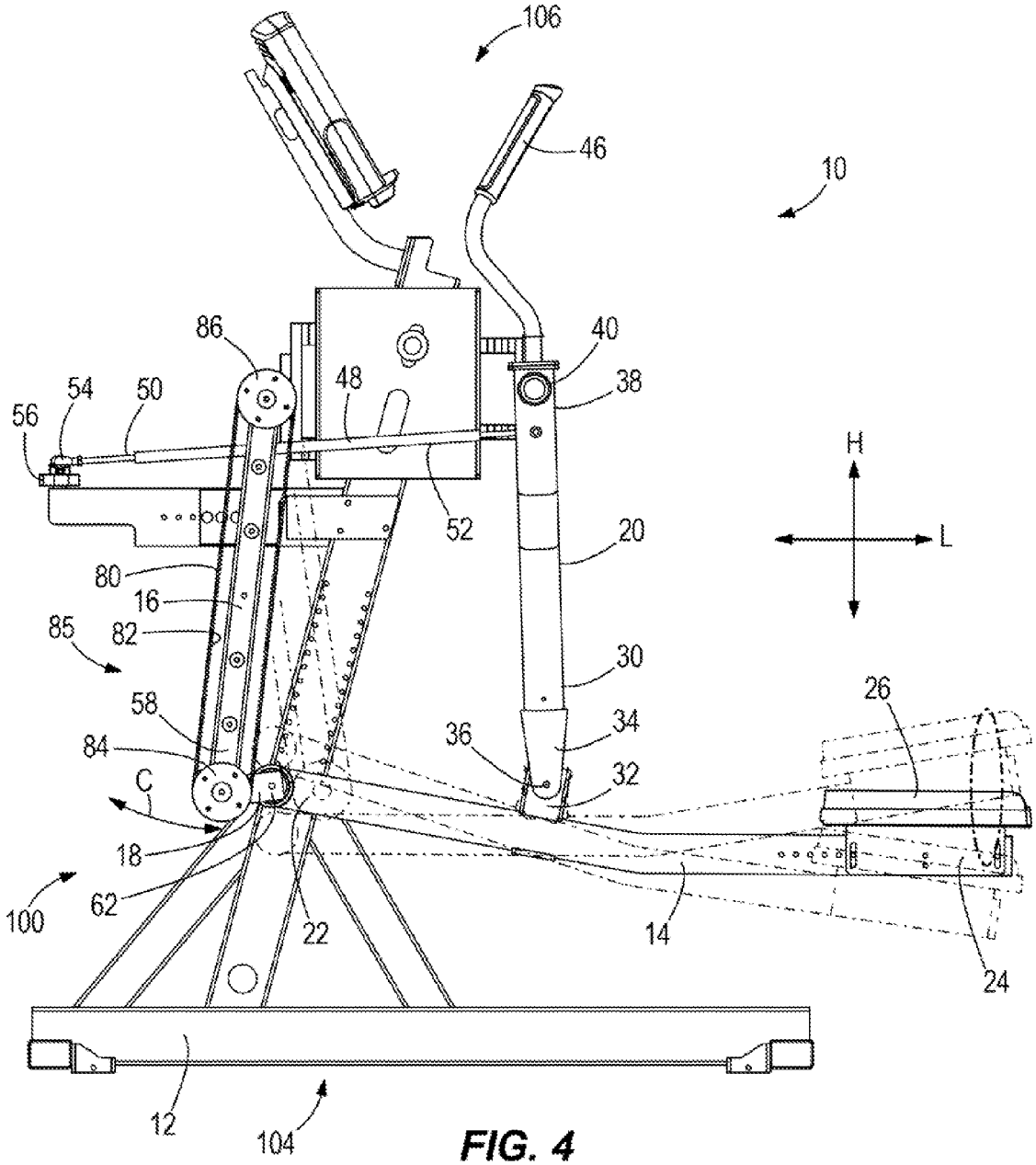
FIG. 4 is a side view of the assembly showing vertical stepping motion.
Figure 5:
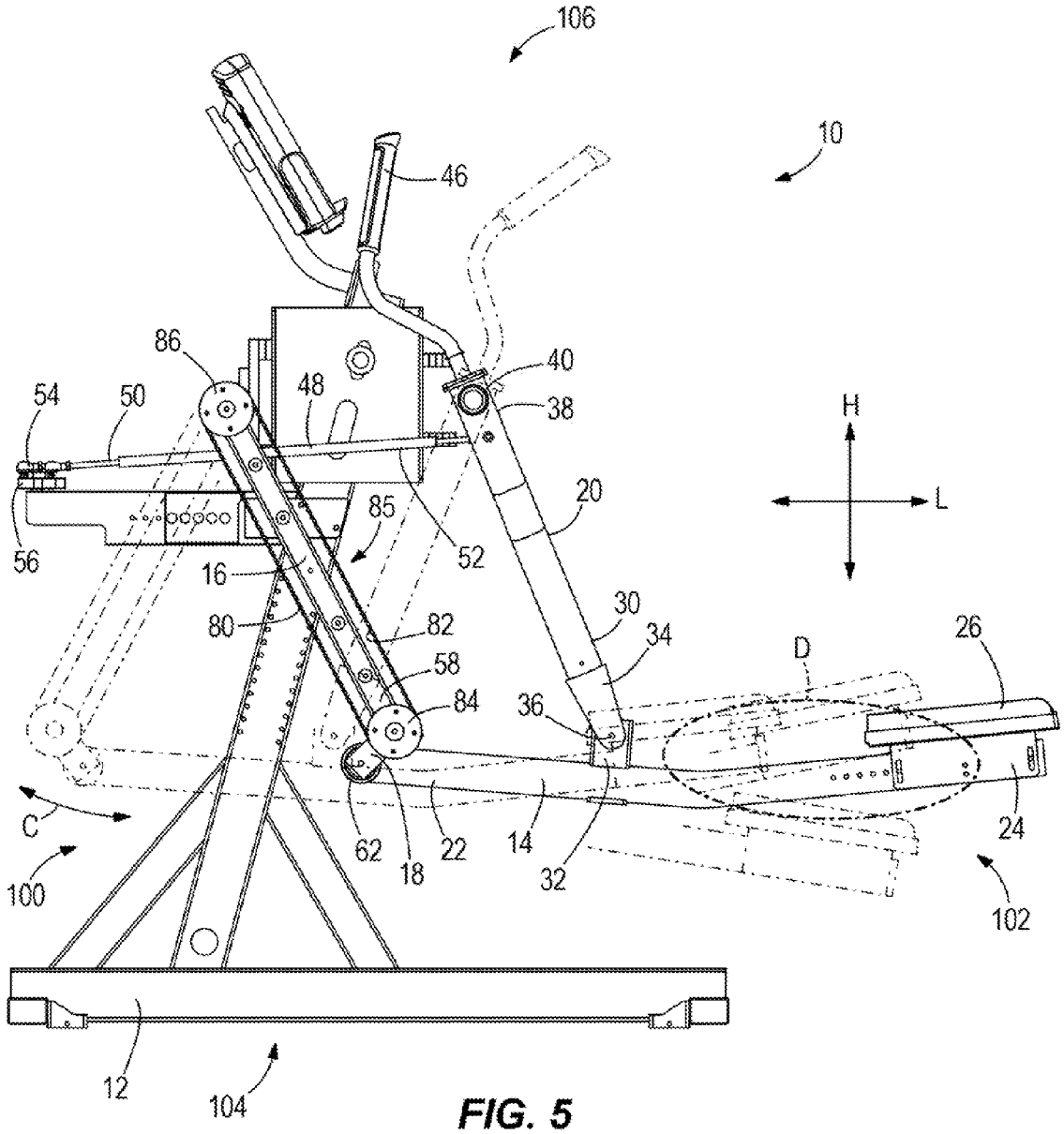
FIG. 5 is a side view of the assembly showing elliptical motion.

FIGS. 4 and 5 depict the exercise assembly 10 during certain exercise motions. In FIG. 4, the operator applies a generally vertical, up and down stepping motion onto the foot pads 26, which causes the foot pedal members 14 to vertically reciprocate as shown in phantom line in FIG. 4. Simultaneously, the user grasps the handles 46. The handles 46 can be maintained generally stationary with respect to the length direction L during vertical reciprocation of the foot pedal members 14. During the movements described above, the crank members 18 pivot in a generally circular path with respect to the foot pedal members 14 and coupler arms 16, as shown by the arrow C. The movement shown at line C can occur in both clockwise and counter-clockwise directions to exercise different muscle groups. During workout activities, the amount of operator hand motion on the handles 46 will help determine the shape of the path of the foot pedal members 14. The stride length of the path can be dynamically changed from short to long or from long to short.

FIG. 5 shows the assembly 10 during an extended stride exercise wherein the user applies movement as shown at line D to the foot pads 26 on the foot pedal members 14. The movement shown at line D can occur in both clockwise and counter-clockwise directions to exercise different muscle groups. The user also applies opposing back and forth motions in the length direction L onto the handles 46. These motions cause the rocker arms 20 and coupler arms 16 to pivot about the respective cross-shafts 40, 72, as shown in phantom line in FIG. 5. Again, the crank members 18 rotate in a generally circular pathway as shown at arrow C.

The noted circular movement of the crank members 18 is transferred to the lower timing pulleys 84, timing belt 80, upper timing pulleys 86, front cross-shaft 72, pulley belt 94, and ultimately to the resistance device 92 for braking function and power generating, per the description in the incorporated U.S. Pat. No. 6,084,325.

As those having ordinary skill in the art would understand, the exercise assembly 10 thus facilitates a movement of the foot pedal members 14 along elliptical, vertical and horizontal paths of differing dimensions when viewed from the first and second sides 108, 110.

Figure 6:
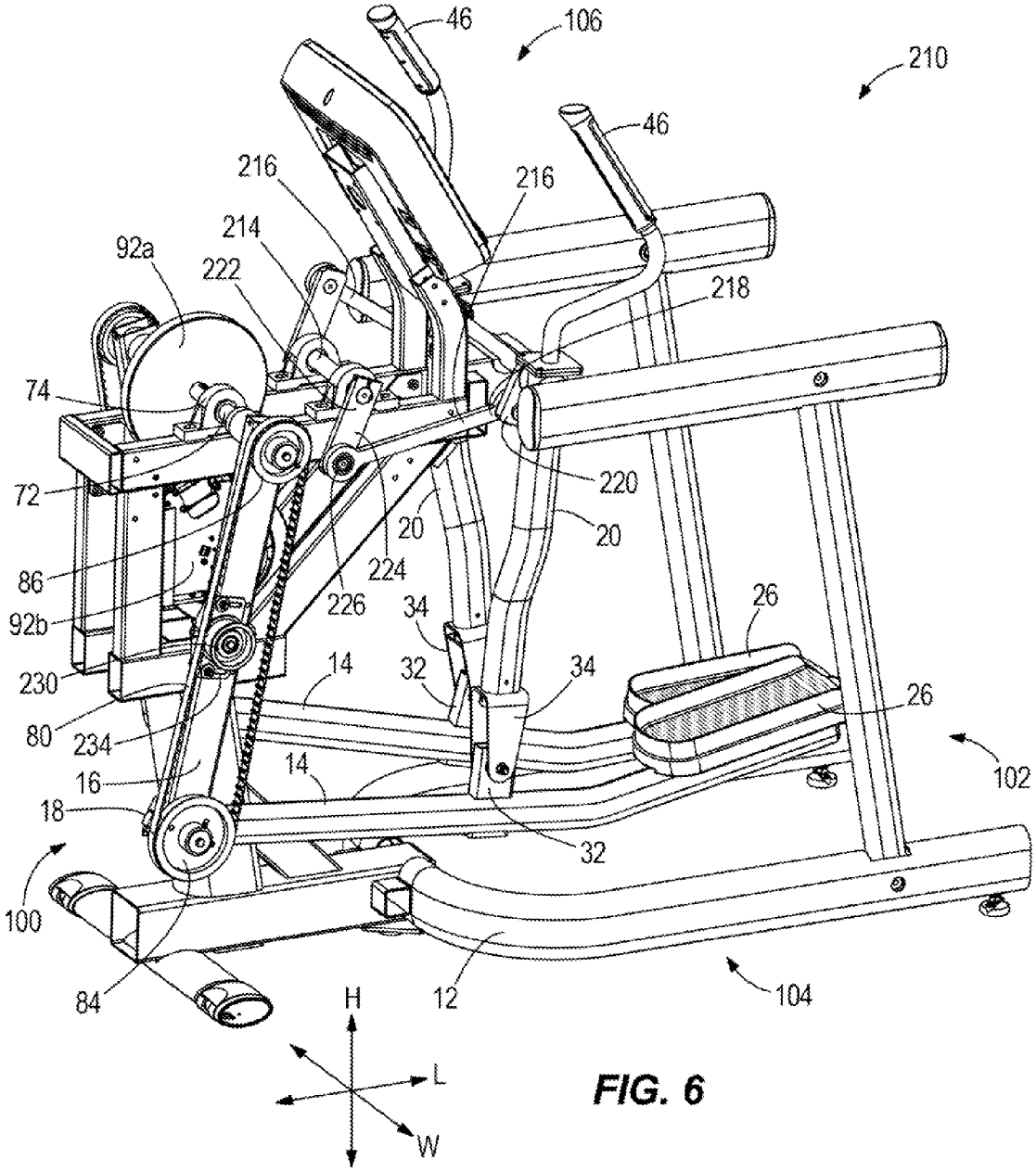
FIG. 6 is a perspective view of another embodiment of an exercise assembly.
Figure 7:
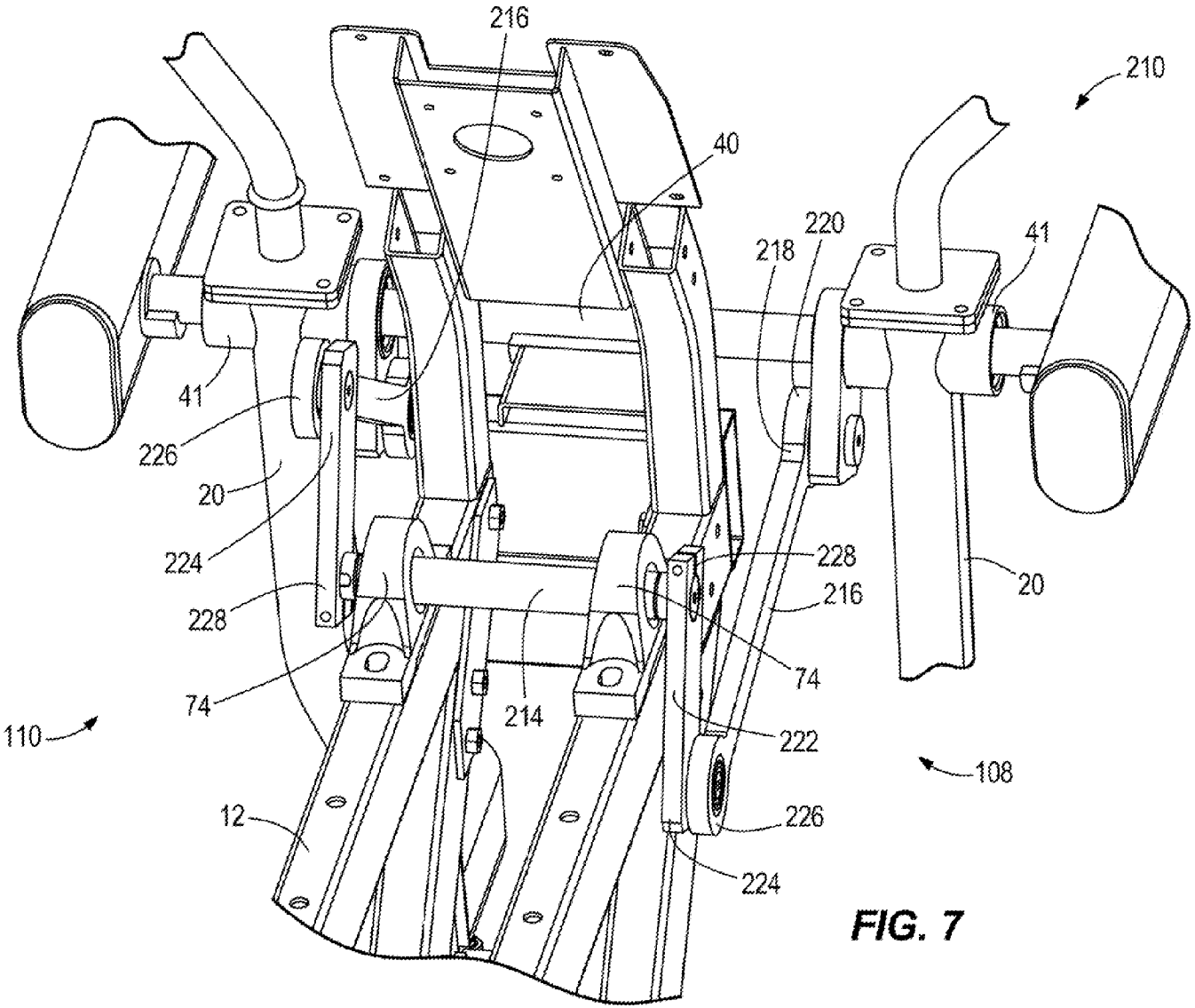
FIG. 7 is a closer view of a front portion of the exercise assembly shown in FIG. 6.
Figure 8:
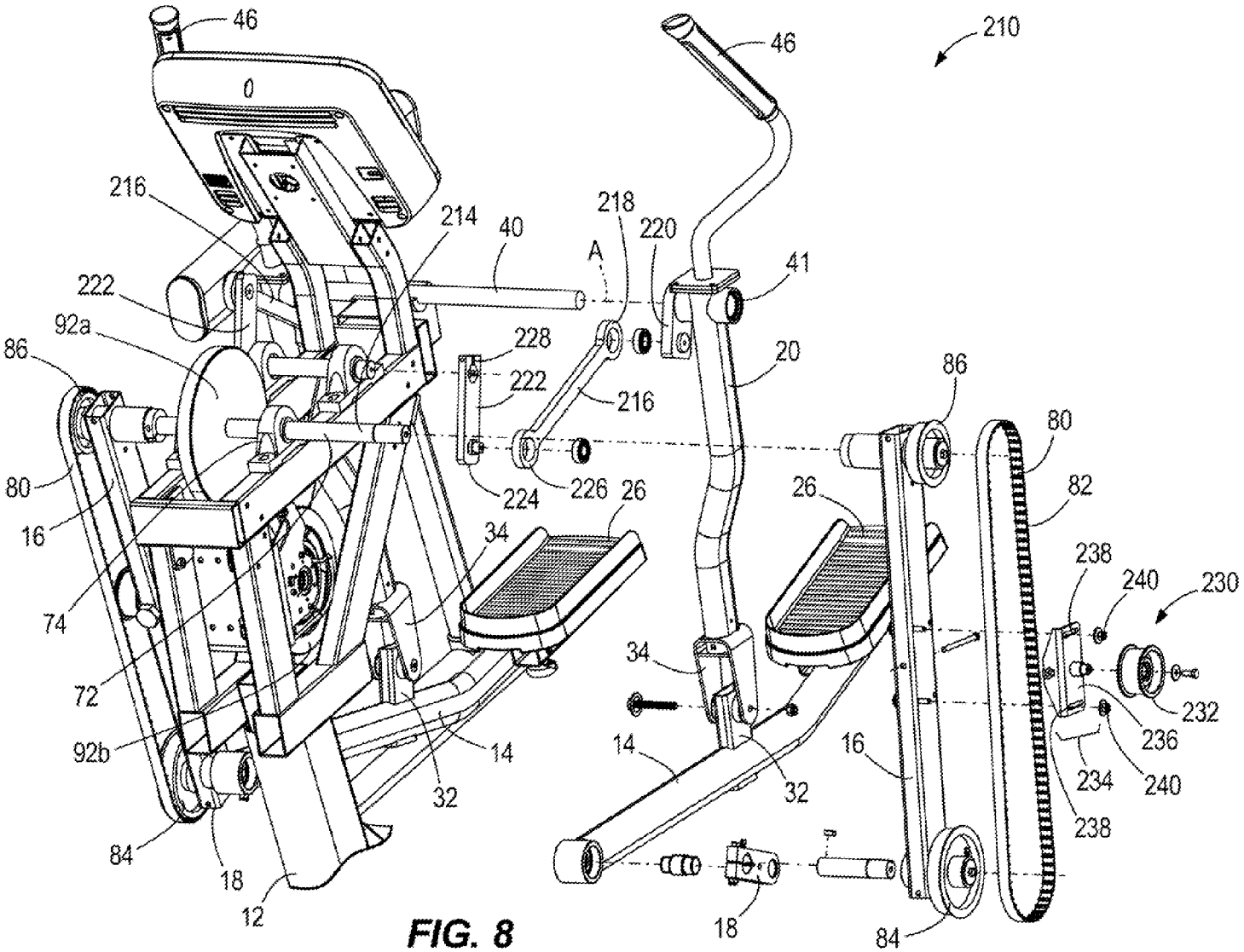
FIG. 8 is an exploded view of one side of the exercise assembly shown in FIG. 6.
Figure 9:
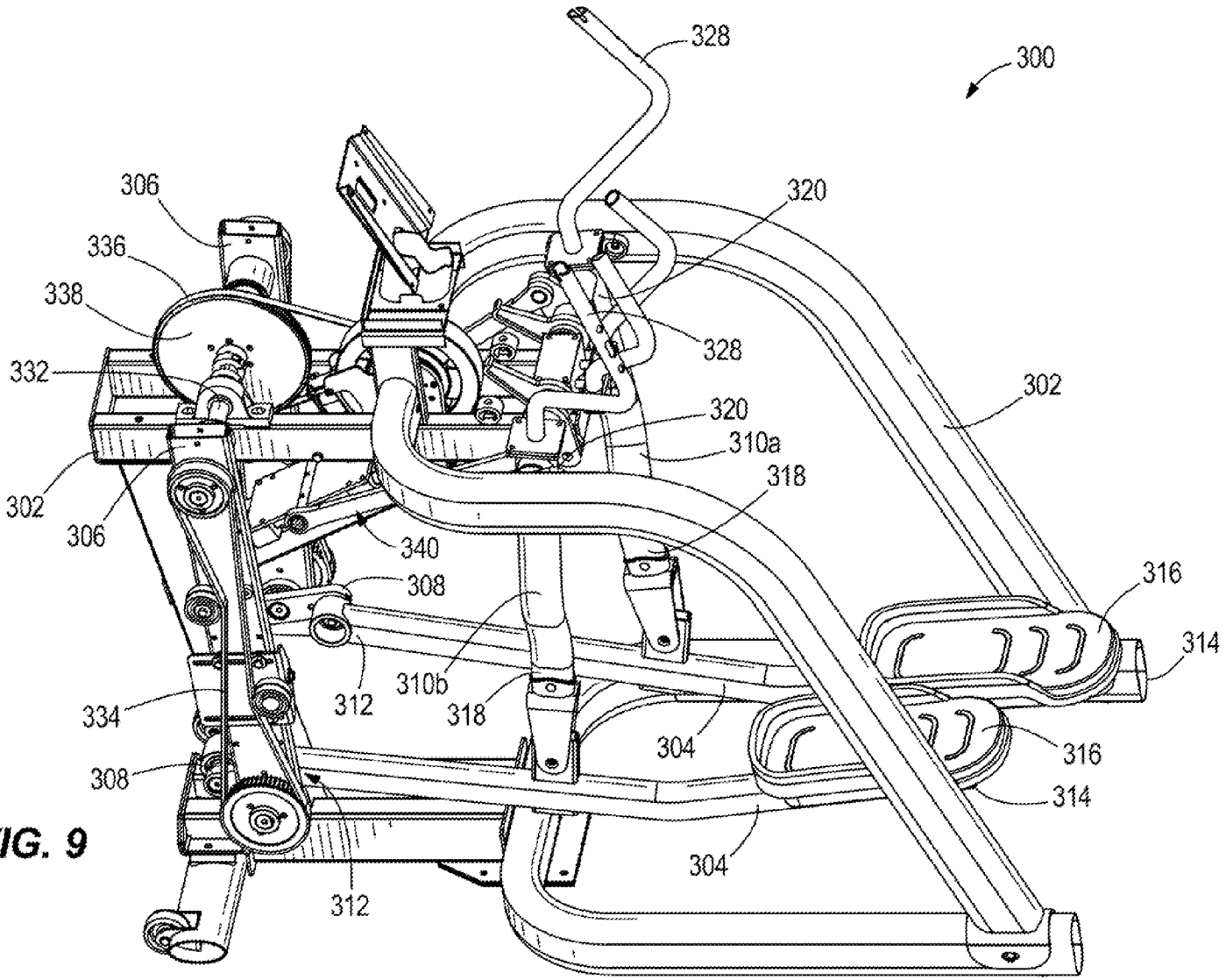
FIG. 9 is a perspective view of another example of an exercise assembly.
Figure 10:
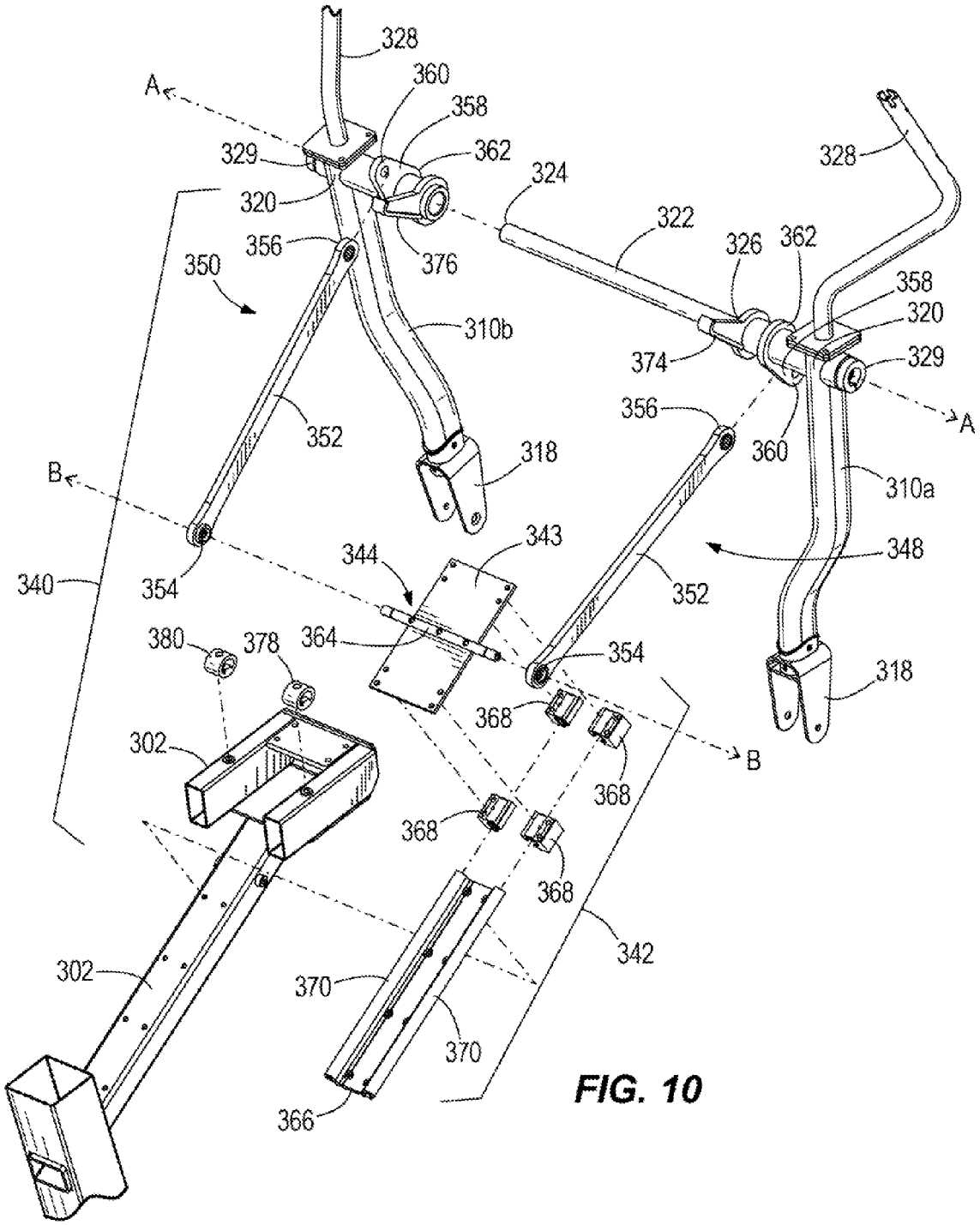
FIG. 10 is an exploded view of one portion of the exercise assembly shown in FIG. 9.

FIGS. 6-8 depict another embodiment of an exercise assembly 210. The exercise assembly 210 has many features in common with or functionally similar to the exercise assembly 10 shown in FIGS. 1-5. Many of the features that are the same or similar in structure and/or function are given like reference numbers. However, all of the reference numbers provided in FIGS. 1-5 are not necessarily provided in FIGS. 6-8 to avoid clutter and maintain clarity of this description.

The exercise assembly 210 differs from the exercise assembly 10 in that it does not include the elongated link members 48, pivotal joints 54, and cross-link member 56. instead, the exercise assembly 210 includes a cross-linking mechanism 212 that pivotally connects the pair of rocker arms 20 together such that movement of one of the pair of rocker arms 20 causes counteracting, opposite movement in the other of the pair of rocker arms 20. The cross-linking mechanism 212 includes a "four-bar mechanism" having a cross-linking shaft 214. A pair of first elongated link members 216 each have a rear portion 218 that is pivotally coupled to one of the pair of rocker arms 20. More specifically, the rear portions 218 are pivotally coupled to extension members 220 that are fixedly coupled to one of the pair of rocker arms 20. in this manner, the pair of first elongated link members pivot with respect to the extension members 220, and thus with respect to the pair of rocker arms 20.

A pair of second elongated link members 222 each have a first portion 224 that is pivotally coupled to a front portion 226 of one of the pair of first elongated link members 216 and a second portion 228 that is fixedly coupled to the cross-linking shaft 214, such that rotation of one of the pair of second elongated link members 222 causes rotation of the cross-linking shaft 14 about its own axis, and rotation of the other of the pair of second elongated link members 222.

In this example, the respective pairs of first and second elongated link members 216, 222 are oppositely oriented with respect to each other and the cross-linking shaft 214. That is, as shown in FIG. 7, the first and second elongated link members 216, 222 on the first side 108 are vertically oriented downwardly, whereas the first and second elongated link members 216, 222 on the opposite, second side 110 are vertically oriented upwardly. The particular orientation of the respective link members 216, 222 can vary from that which is shown.

Movement of one of the pair of rocker arms 20 causes pivoting movement of one of the pair of first elongated link members 216 via the fixed extension member 220. Pivoting movement of the first elongated link member 216 causes pivoting movement of a corresponding one of the pair of second elongated link members 222. Pivoting movement of the second elongated link member 222 causes rotation of the cross-linking shaft 214 about its own axis, which is translated to the other of the pair of second elongated link members 222, which in turn causes pivoting movement of the other of the first elongated link member 216. Movement of the other of the first elongated link member 216 is translated to the other of the pair of rocker arms 20 via the extension member 220. Thus, the cross-linking mechanism 212 operably connects the pair of rocker arms 20 together.

The exercise assembly 210 shown in FIGS. 6-8 also differs from the exercise assembly 10 in that it includes a pair of belt tightening mechanisms 230 for adjusting tension in the pair of timing belts 80. Each pair of belt tightening mechanisms includes an idler wheel 232 that is coupled to one of the pair of coupler arms 16 by a joint 234. The joint 234 includes a plate 236 having at least one slot 238 that receives a fixing screw 240. The fixing screw can be fixed to the plate at different slot locations along the length of the slot 238 such that the idler wheel 232 is fixed at different locations with respect to the coupler arm 16. Adjusting the position of the idler wheel 232 transversely outwardly with respect to the elongated coupler arm 16 forces the outer radius of the idler wheel 232 against the internal grooves 82 on the timing belt 80, thus tensioning the timing belt 80. Opposite movement of the idler wheel 232 via the movable joint 234 releases tension on the timing belt 80.

The exercise assembly 210 shown in FIGS. 6-8 also differs from the exercise assembly 10 in that it includes a pair of resistance devices 92*a*, 92*b*. As discussed above, regarding the exercise assembly 10, the number and configuration of the resistance devices can vary.

FIGS. 9-13 depict another example of an exercise assembly 300 having a frame 302, a pair of elongated foot pedal members 304, a pair of elongated coupler arms 306, a pair of crank members 308 and a pair of elongated rocker arms 310*a*, 310*b*. Each foot pedal member 304 has a front portion 312 and a rear portion 314. A pair of foot pads 316 is provided for supporting a user's feet. Each foot pad 316 is disposed on the rear portion 314 of one of the pair of foot pedal members 304. Each rocker arm 310*a*, 310*b* has a lower portion 318 that is pivotally connected to one of the pair of foot pedal members 304 at a location that is between the foot pad 316 and the crank member 308. Any type of pivotal connection can be employed. The manner of connection of the rocker arms 310*a*, 310*b* to the foot pedal members 304 is similar to the embodiments described herein above and therefore is not here described, for brevity.

As in the previous embodiments, each rocker arm 310*a*, 310*b* has an upper portion 320 that is directly or indirectly pivotally connected to the frame 302. The manner of connection to the frame 302 can vary. In this example, a rear cross-shaft 322 (see FIG. 10) is secured to the frame 302 and has opposite ends 324, 326 on which the upper portions 320 of the rocker arms 310*a*, 310*b* are pivotally supported. In this example, the ends 324, 326 extend through respective bearings 328 in the rocker arms 310*a*, 310*b* to enable the freely rotatable, pivotal connection therewith. Thus, the pair of rocker arms 310*a*, 310*b* pivot about a common pivot axis A, which extends through the rear cross-shaft 322.

A pair of handles 328 is disposed on the pair of rocker arms 310*a*, 310*b* and extends upwardly above the cross-shaft 322 such that movement of the handles 328 in a pivoting, scissors-like motion with respect to the axis A causes similar, following pivoting, scissors-like motion of the lower portion 318 of the rocker arm 310*a*, 310*b*.

The coupler arms 306, crank members 306 and an associated bearing and through shaft assembly 332, a pair of timing belts 334, pulley 336 and resistance device 338 can be constructed to function in a similar manner to the embodiments described herein above regarding FIGS. 1-8 and therefore are not further here described, for brevity.

Instead of the elongated link members 48, and cross-link member 56 of the embodiment shown in FIGS. 1-5, and instead of the cross-linking mechanism 212 shown in the embodiment of FIGS. 6-8, the exercise assembly 300 includes a linear motion synchronizing mechanism 340 (we FIG. 10) that provides symmetric left-right synchronization of the rocker arms 310*a*, 310*b*. The linear motion synchronizing mechanism 340 can allow for a compact design and flexible mounting orientation in comparison to other linking arrangements.

The linear motion synchronizing mechanism 340 includes a slider 342 having a slider body 344 that slides along a linear axis L (see FIGS. 11-13) extending through and perpendicular to the pivot axis A. A linkage pivotally couples the first and second rocker arms 310*a*, 310*b* to the slider body 344. As will be discussed further herein below, pivoting the first and second rocker arms 310*a*, 310*b* with respect to each other causes the slider body 344 to slide in a first direction along the linear axis L. Opposite pivoting of the first and second rocker arms 310*a*, 310*h* with respect to each other causes the slider body 344 to slide in an opposite, second direction along the linear axis L. The slider 342 and the linkage together restrict pivoting motion of the first and second rocker arms 310*a*, 310*b* to opposite directions and at an equal angular velocity with respect to each other.

The linkage includes a first linkage portion 348 (see FIG. 10) for the first rocker arm 310*a* and an oppositely oriented second linkage portion 350 for the second rocker arm 310*b*. The first and second linkage portions 348, 350 are pivotally connected to the slider 342 at a second pivot axis B. The second pivot axis B extends parallel to the first pivot axis A. Each of the first and second linkage portions 348, 350 includes a linear extension arm 352 having first and second ends 354, 356 and a radial crank arm 358 having first and second ends 360, 362. The first end 354 of the extension arm 352 is pivotally coupled to the slider 342 at the second pivot axis B. The second end 356 of the extension arm 352 is pivotally coupled to the first end 360 of the crank arm 358. The second end 362 of the crank arm 358 is fixed to and rotates with one of the first and second rocker arms 310.

Figure 11:
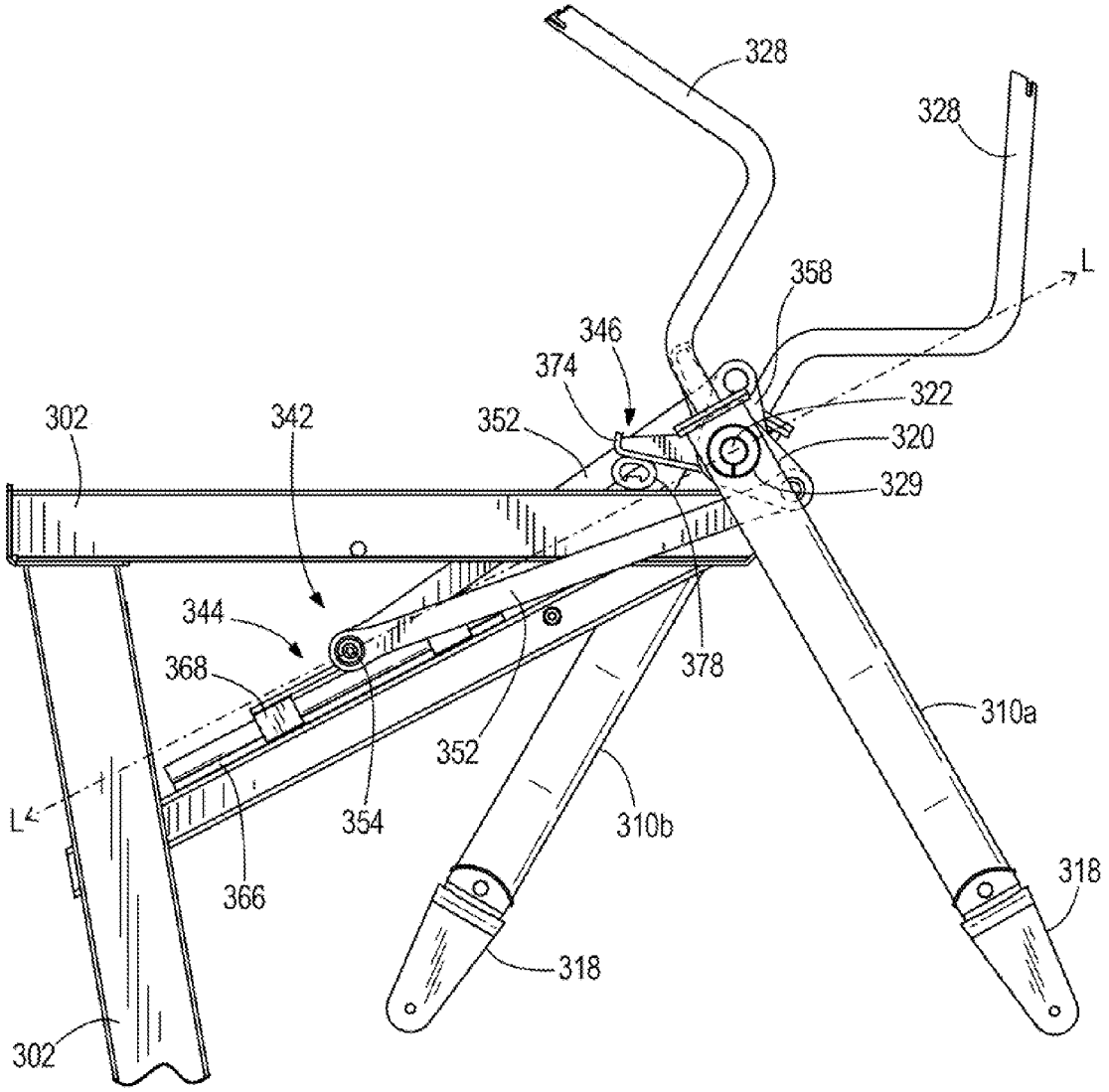
FIGS. 11-13 are side views of the portion of the exercise assembly, showing scissors-like motion of a pair of elongated rocker arms shown in FIG. 9.
Figure 12:
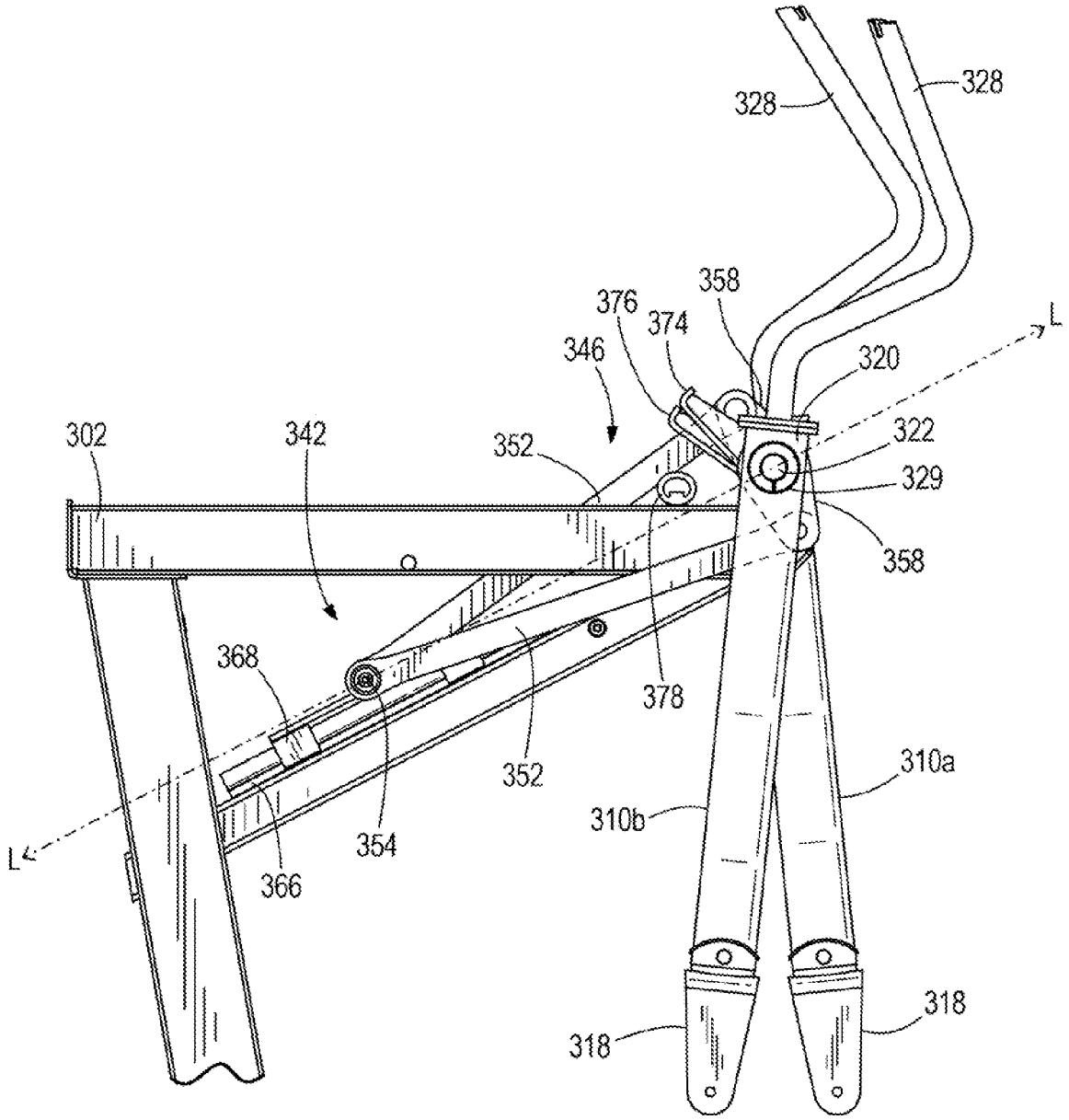
Figure 13:
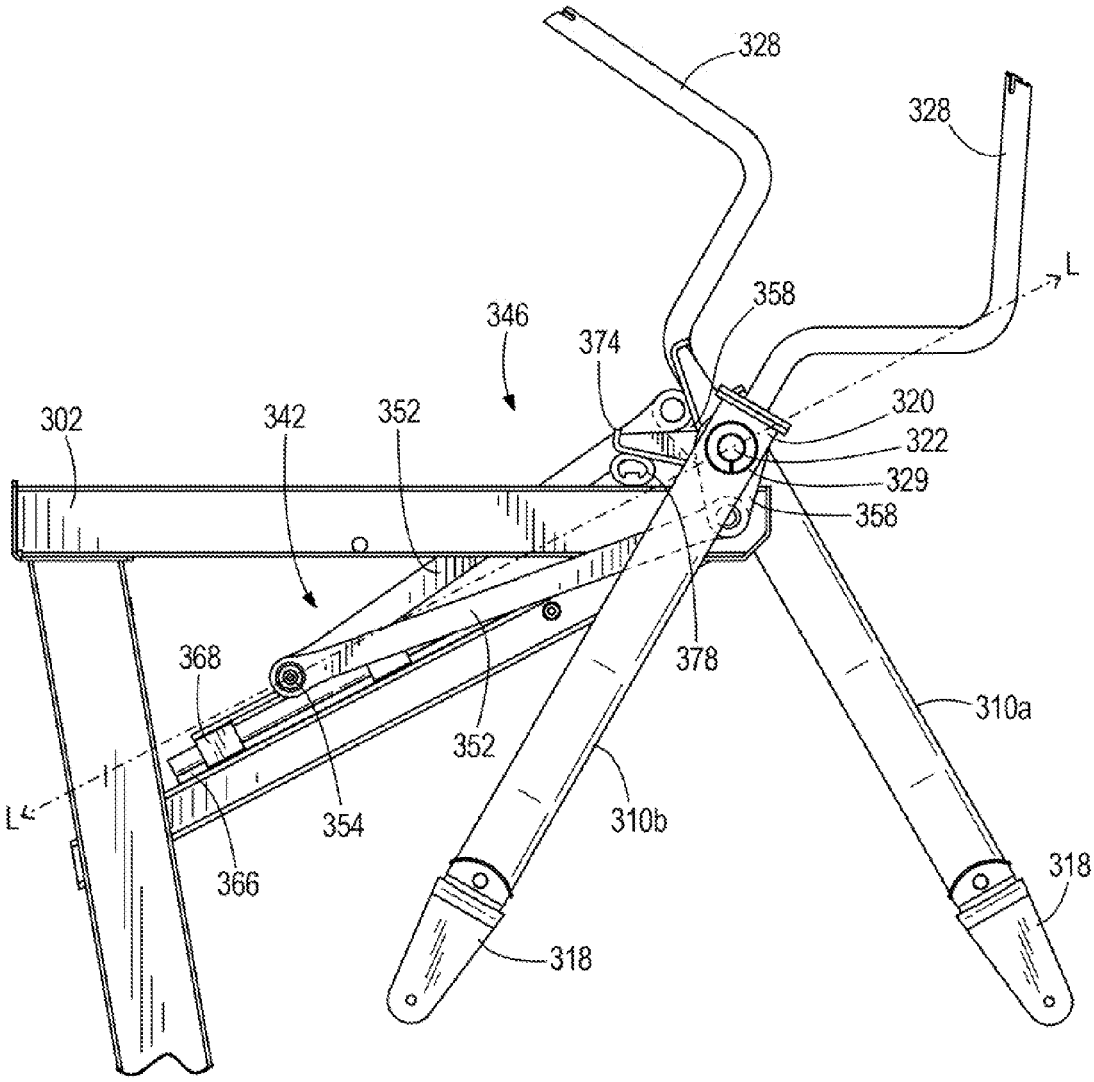

The slider 342 includes a bed 343 and pivot shaft 364 that extends along the noted second pivot axis B between the first ends 354 of the extension arms 352. The slider 342 also includes a stationary base 366 and linear bearings 368 that slide along linear tracks 370 on the stationary base 366. The linear bearings 368 include two pairs of spaced apart linear bearings. A pair of spaced apart and parallel linear tracks 370 extends parallel to the linear axis L. The bed 343 and pairs of spaced apart linear bearings 368 together slide on the pair of linear tracks 370, as shown in FIGS. 11-13, when the first and second rocker arm 310*a*, 310*h* are pivoted with respect to each other in the noted scissors-like motion about the first pivot axis A.

The slider 342 also includes the pivot shaft 364 that extends along the second pivot axis 13 between the first ends 354 of the extension arms 352. The first end 360 of the crank arm 358 of the first linkage 346 is located on and pivots about a first side of the pivot shaft 364. The first end 360 of the crank arm 358 of the second linkage 350 is located on and pivots about a second, opposite side of the pivot shaft 364. As shown in the side views of FIGS. 10-13, the crank arms 358 of the first and second linkages 348, 350 extend at opposite radial angles from the first pivot axis A.

The linear motion synchronizing mechanism 340 can optionally include a mechanical stop that prevents over-rotation of the first and second rocker arms 310. The mechanical stop can include first and second stop arms 374, 376 that are fixed to and rotate with the respective first and second rocker arms 310. The first and second stop arms 374, 376 extend at equal radial angles from the first pivot axis A. In this example, first and second fixed spring members 378, 380 are fixed to the frame 302 for engaging with the first and second stop arms 374, 376, thus preventing the noted over-rotation of the first and second rocker arms 310.

What is claimed is:

1. An exercise assembly comprising:

elongated first and second rocker arms that pivot with respect to each other in a scissors-like motion about a first pivot axis based upon an operator exercise motion;

a slider having a slider body that slides along a linear axis extending through and perpendicular to the first pivot axis; and a linkage that pivotally couples the first and second rocker arms to the slider body;

wherein pivoting the first and second rocker arms with respect to each other causes the slider body to slide in a first direction along the linear axis and wherein opposite pivoting of the first and second rocker arms with respect to each other causes the slider body to slide in an opposite, second direction along the linear axis.

2. The assembly according to claim 1, wherein the slider and the linkage together restrict pivoting motion of the first and second rocker arms to opposite directions and at an equal angular velocity with respect to each other.

3. The assembly according to claim 1, wherein the linkage comprises a first linkage portion for the first rocker arm and a second linkage portion for the second rocker arm, the first and second linkage portions being pivotally connected to the slider at a second pivot axis.

4. The assembly according to claim 3, wherein the second pivot axis extends parallel to the first pivot axis.

5. The assembly according to claim 3, wherein each of the first and second linkage portions comprises a linear extension arm having first and second ends and a radial crank arm having first and second ends, wherein the first end of the extension arm is pivotally coupled to the slider at the second pivot axis, wherein the second end of the extension arm is pivotally coupled to the first end of the crank arm, and wherein the second end of the crank arm is fixed to and rotates with one of the first and second rocker arms.

6. The assembly according to claim 5, wherein the slider comprises a pivot shaft that extends along the second pivot axis between the first ends of the extension arms.

7. The assembly according to claim 6, wherein the first end of the crank arm of the first linkage is located on a first side of the pivot shaft and wherein the first end of the crank arm of the second linkage is located on a second, opposite side of the pivot shaft.

8. The assembly according to claim 5, wherein the crank arms of the first and second linkages extend at equal but opposite radial angles from first pivot axis.

9. The assembly according to claim 8, comprising a mechanical stop preventing over-rotation of the first and second rocker arms.

10. The assembly according to claim 9, wherein the mechanical stop comprises first and second stop arms fixed to and rotating with the first and second rocker arms, respectively, the first and second stop arms extending at equal radial angles from first pivot axis.

11. The assembly according to claim 10, comprising first and second fixed spring members engaging with the first and second stop arms, respectively, preventing over-rotation of the first and second rocker arms, respectively.

12. The assembly according to claim 1, wherein the slider comprises a stationary base; wherein the slider body comprises at least one linear bearing that linearly slides along the at least one linear track on the stationary base.

13. The assembly according to claim 12, wherein the at least one linear bearing comprises at least two pairs of spaced apart linear bearings, wherein the at least one linear track comprises at least a pair of linear tracks that are spaced apart and parallel, and wherein the pairs of spaced apart linear bearings slide on the pair of linear tracks.

14. An exercise assembly comprising:

a frame;

a pair of elongated foot pedal members, each foot pedal member having a front portion and a rear portion:

a pair of foot pads, each foot pad being disposed on the rear portion of one of the pair of foot pedal members;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and haying a second portion that is pivotally connected to the lower portion of one of the pair of coupler arms, such that each crank member is rotatable in a circular path; and a pair of elongated rocker arms, each rocket arm having a lower portion that is pivotally connected to one of the pair of foot pedal members in between the foot pad and the crank member and having an upper portion that is pivotally connected to the frame;

wherein the pair of foot pedal members are each movable along user-defined paths of differing dimensions;

wherein the pair of rocker arms oppositely pivot with respect to each other and the frame in a scissors-like motion about a first pivot axis;

a slider having a slider body that slides along a linear axis extending through and perpendicular to the first pivot axis; and a linkage that pivotally couples the first and second rocker arms to the slider body;

wherein pivoting the pair of rocker arms with respect to each other causes the slider body to slide in a first direction along the linear axis and wherein opposite pivoting of the pair of rocker arms with respect to each other causes the slider body to slide in an opposite, second direction along the linear axis.

15. The assembly according to claim 14, further comprising a pair of handles, each handle disposed on one of the pair of rocker arms.

16. The assembly according to claim 15, wherein the lower portions of the pair of rocker arms are pivotally attached to the pair of foot pedal members.

17. The exercise assembly according to claim 15, wherein the slider and the linkage together restrict pivoting motion of the first and second rocker arms to opposite directions and at an equal angular velocity with respect to each other.

18. The exercise assembly according to claim 15, wherein the linkage comprises a first linkage portion for the first rocker arm and a second linkage portion for the second rocker arm, the first and second linkage portions being pivotally connected to the slider at a second pivot axis.

19. The exercise assembly according to claim 18, wherein the second pivot axis extends parallel to the first pivot axis.

20. The exercise assembly according to claim 18, wherein each of the first and second linkage portions comprises a linear extension arm having first and second ends and a radial crank arm having first and second ends, wherein the first end of the extension arm is pivotally coupled to the slider at the second pivot axis, wherein the second end of the extension arm is pivotally coupled to the first end of the crank arm, and wherein the second end of the crank arm is fixed to and rotates with one of the first and second rocker arms.

21. The exercise assembly according to claim 20, wherein the slider comprises a pivot shaft that extends along the second pivot axis between the first ends of the extension arms.

22. The exercise assembly according to claim 21, wherein the first end of the crank arm of the first linkage is located on a first side of the pivot shaft and wherein the first end of the crank arm of the second linkage is located on a second, opposite side of the pivot shaft.

23. The exercise assembly according to claim 20, wherein the crank arms of the first and second linkages extend at equal but opposite radial angles from first pivot axis.

24. The exercise assembly according to claim 23, comprising a mechanical stop preventing over-rotation of the first and second rocker arms.

25. The exercise assembly according to claim 24, wherein the mechanical stop comprises first and second stop arms fixed to and rotating with the first and second rocker arms, respectively, the first and second stop arms extending at opposite radial angles from first pivot axis.

26. The exercise assembly according to claim 25, comprising first and second fixed spring members preventing over-rotation of the first and second rocker arms, respectively.

27. The exercise assembly according to claim 15, wherein the slider comprises a stationary base; wherein the slider body comprises at least one linear bearing that linearly slides along the at least one linear track on the stationary base.

28. The exercise assembly according to claim 27, wherein the at least one linear bearing comprises at least two pairs of spaced apart linear bearings, wherein the at least one linear track comprises at least a pair of linear tracks that are spaced apart and parallel, and wherein the pairs of spaced apart linear bearings slide on the pair of linear tracks.

29. An exercise assembly comprising:

elongated first and second rocker arms that pivot with respect to each other in a scissors-like motion about a first pivot axis;

a slider having a slider body that slides along a linear axis extending through and perpendicular to the first pivot axis; and a linkage that pivotally couples the first and second rocker arms to the slider body;

wherein the slider and the linkage together restrict pivoting motion of the first and second rocker arms to opposite directions and at an equal angular velocity with respect to each other;

wherein the linkage comprises a first linkage portion for the first rocker arm and a second linkage portion for the second rocker arm, the first and second linkage portions being pivotally connected to the slider at a second pivot axis;

wherein the second pivot axis extends parallel to the first pivot axis;

wherein each of the first and second linkage portions comprises a linear extension arm having first and second ends and a radial crank arm having first and second ends, wherein the first end of the extension arm is pivotally coupled to the slider at the second pivot axis, wherein the second end of the extension arm is pivotally coupled to the first end of the crank arm, and wherein the second end of the crank arm is fixed to and rotates with one of the first and second rocker arms;

wherein pivoting the first and second rocker arms with respect to each other causes the slider body to slide in a first direction along the linear axis and wherein opposite pivoting, of the first and second rocker arms with respect to each other causes the slider body to slide in an opposite, second direction along the linear axis.

30. The exercise assembly according to claim 29, wherein the crank arms of the first and second linkages extend at equal but opposite vertical angles from first pivot axis.

* * * * *